US006083447A

United States Patent [19]

Turner

[11] Patent Number: 6,083,447

[45] **Date of Patent: *Jul. 4, 2000**

[54] METHOD FOR MOLDING ARTICLES FROM A FIBROUS SLURRY

[75] Inventor: Todd Thomas Turner, Florence, Ky.

[73] Assignee: Cin-Made Packaging Group, Inc., Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,672

[22] Filed: Jun. 17, 1997

[51] Int. Cl.[7] ..... D21F 1/48

[52] U.S. Cl. ..... 264/401; 249/134; 162/217; 162/387; 162/411; 264/87; 264/219; 425/85

[58] Field of Search ..... 264/87, 219, 651, 264/40.1; 425/85; 162/217, 387, 411; 249/134

[56] References Cited

U.S. PATENT DOCUMENTS

| | | | |
|---|---|---|---|
| 3,166,467 | 1/1965 | Keifers et al. | 264/87 |
| 3,848,040 | 11/1974 | Confer et al. | 264/651 |
| 4,888,095 | 12/1989 | Gulya et al. | 162/217 |
| 4,908,174 | 3/1990 | Will | 264/87 |
| 5,356,578 | 10/1994 | Isomura et al. | 264/87 |
| 5,468,135 | 11/1995 | Thomas | 264/87 |
| 5,522,717 | 6/1996 | Matsumoto et al. | 249/134 |

*Primary Examiner*—James Derrington
*Attorney, Agent, or Firm*—Mark F. Smith; Smith, Guttag & BolinLtd

[57] ABSTRACT

An apparatus and method for molding articles from a fibrous slurry. The apparatus comprises a forming die manufactured from a water insoluble, porous, relatively rigid and easily shaped material having molding surface shaped to the contour of the article to be molded, a vacuum vessel for receiving the forming die, and an opening through the vacuum vessel for communicating with a vacuum means for applying suction through the forming die to draw the slurry against the molding surfaces to form a fiber layer having the configuration of the article to be molded. The method for molding articles from a fibrous slurry comprises the steps of producing a forming die having molding surfaces contoured to the shape of the article to be molded using hand-held cutting tools, or manual tools, or automatically with computer controlled tools; inserting the forming die into the fibrous slurry; applying suction through the forming die to draw the fibrous slurry against the molding surfaces of the forming die; and removing the forming die from the fibrous slurry.

11 Claims, 6 Drawing Sheets

METHOD FOR MOLDING ARTICLES FROM A FIBROUS SLURRY

FIELD OF THE INVENTION

This invention relates to the production of molded products from a slurry and, more particularly, to an apparatus and method for molding articles from a fibrous slurry.

BACKGROUND OF THE INVENTION

In order to prevent damage during transporting and storage, electronic equipment, machines, and other fragile products are usually enclosed or covered with a packing or cushioning material and placed within paper board boxes.

Typically, such packing or cushioning material have been manufactured from a synthetic resin, such as a plastic or styrene foams, which are formed to conform with the outer shape of the products to provide a protective cushion. Unfortunately, however, while plastic and styrene resin foams are light in weight and inexpensive to manufacture, their use is an environmental concern because they are not perishable and do not naturally decompose in land fills. Further, when incinerated, plastic and styrene resin foams often produce noxious gases and generate a significant degree of heat which can result in damage to the combustion facility. Accordingly, alternative packing or cushioning materials have been developed which are pollution-free, inexpensive, and relatively easy to manufacture.

One alternative material which has been found to be suitable for use as a packing or cushioning material is produced by mixing together water and paper, including virgin, recycled or waste paper, to form a fibrous pulp slurry. The fibrous pulp slurry can be molded into finished articles having contoured shapes for receiving the products to be protected. Such molded articles have relatively good shock-absorbing characteristics, are relatively inexpensive to produce in large quantities, are biodegradable, and do not produce noxious gases or generate a significant degree of heat when incinerated. Accordingly, the use of such molded articles for use as packing or cushioning material is highly desirable.

Molded articles formed from a fibrous slurry, such as a pulp slurry, are typically produced by the process of matting the slurry fibers onto one side of a forming die by first inserting the die into the slurry. A vacuum is then applied in such a manner that the water comprising the slurry passes through perforations or channels in the die thereby leaving a layer of wet fibers deposited on the die surface. After sufficient water has been drawn to obtain the required thickness of the fiber layer, the die is removed from the slurry. The formed molded article can then be removed from the forming die by various conventional means.

One problem associated with producing molded articles from a fibrous slurry is the need to prepare specimens which can be tested for their shock-absorbing characteristics. Often a molded article requires numerous design changes, each requiring the production of a test specimen, before a final configuration is selected which provides the necessary shock-absorbing protection.

Another problem associated with producing molded articles from a slurry is the need for the article manufacturer to provide potential customers with specimens having the appearance of the final production article for use in analyzing sale proposals analysis.

One conventional forming die utilized for producing molded articles from a fibrous slurry comprises a metallic or rigid plastic block having a molding surface formed by machining or electroforming techniques to the same contoured shape as the finished article. A plurality of perforations are typically drilled through the molding surface to permit the passage of air and water during molding operations.

Another conventional forming die utilized for molding packing or cushioning articles from a fibrous slurry comprises a porous block formed from ceramic or glass beads bonded together by a resin within a master mold configured for producing a forming mold having molding surfaces with the same contoured shape as the finished article.

Unfortunately, however, while such conventional forming dies are capable of manufacturing quantities of molded articles from a fibrous slurry, their manufacture requires relatively labor intensive, time consuming, and expensive pattern making, molding, machining and drilling, or electroforming operations. Accordingly, a common problem among conventional forming dies for forming molded articles from a fibrous slurry is the inability of producing specimens for testing in a relatively short amount of time and with relatively little expense. Therefore, a need exist for a method and apparatus for producing molded articles from a fibrous slurry, which can be utilized to provide specimens for testing and evaluation in a relatively little time and with little expense.

SUMMARY OF THE INVENTION

The present invention is directed to an apparatus and method for molding articles from a fibrous slurry. The apparatus for molding an article from a fibrous slurry comprises a forming die having molding surfaces contoured to the same shape as the article to be molded; a vacuum vessel for receiving the forming die and having at least one opening for communicating with a vacuum means for applying vacuum pressure to effect suction through the forming die to draw the slurry against the forming die; wherein the forming die comprises a water insoluble, porous material which is capable of withstanding the vacuum pressure and which is easily shaped either by hand using hand-held cutting tools or by machine using manual tools or computer controlled cutting tools.

In another preferred embodiment of the invention, a method for molding articles from a fibrous slurry comprises the steps of constructing a forming die having molding surfaces contoured to the same shape as the article to be molded formed from a water insoluble, porous material which is capable of withstanding the vacuum pressure and which is easily shaped either by hand using hand-held cutting tools or by machine using manual tools or computer controlled cutting tools; disposing the forming die into a vacuum vessel having an opening for communicating with a vacuum means; and applying suction through the forming die to draw the slurry against the molding surfaces to form a fiber layer having the configuration of the fibrous article to be molded and for drawing the water comprising the slurry through the forming die.

In a preferred embodiment of the invention, the forming die is manufactured from a water insoluble, porous, and relatively rigid and easily shaped material comprising an open pattern of micronically sized interconnected cells which join together to form passages extending through the forming die.

In a preferred embodiment of the invention, the forming die comprises a synthetic resin foam material.

In another preferred embodiment of the invention, the forming die comprises a phenol-formaldehyde resin foam material.

In another preferred embodiment of the invention, the forming die comprises a polyurethane foam material.

In another preferred embodiment of the invention, the forming die comprises a ceramic material.

In another preferred embodiment of the invention, the forming die comprises a foam metal.

In another preferred embodiment of the invention, the forming die includes a plurality of perforations extending inwardly through the die.

In another preferred embodiment of the invention, the apparatus and method for molding articles from a fibrous slurry further comprises means for removing the formed article from the forming die.

In another preferred embodiment of the invention, the apparatus and method for molding articles from a fibrous slurry further comprises a transfer die manufactured from a water insoluble, porous, and relatively rigid and easily shaped material.

In another preferred embodiment of the invention, the apparatus and method for molding articles from a fibrous slurry further comprises means for drying the formed article.

A primary object of this invention, therefore, is to provide an apparatus and a method for molding articles from a fibrous slurry.

Another primary object of this invention is to provide an apparatus and a method for molding articles from a fibrous slurry which requires relatively little time and expense.

Another primary object of this invention is to provide an apparatus and a method for molding articles from a fibrous slurry which does not require time consuming and expensive pattern making, molding, machining and drilling, or electroforming operations.

Another primary object of this invention is to provide an apparatus and a method for molding articles from a fibrous slurry which does not require the use of master molds or pre-forms.

Another primary object of this invention is to provide an apparatus and a method for molding articles from a fibrous slurry which produces articles capable of being tested to determine the shock-absorbing characteristics of the final production product.

Another primary object of this invention is to provide an apparatus and a method for molding articles from a fibrous slurry which have the appearance and accurately represents the final production product.

Another primary object of this invention is to provide an apparatus and a method for molding articles from a fibrous slurry utilizing a molding die which is relatively inexpensive to manufacture.

Another primary object of this invention is to provide an apparatus and a method for molding articles from a fibrous slurry utilizing a molding die which may be manufactured in a relatively short period of time.

These and other objects and advantages of the invention will be apparent from the following description, the accompany drawings and the appended claims.

DETAILED DESCRIPTION OF THE PREFERRED EMBODIMENTS

Figure 1:
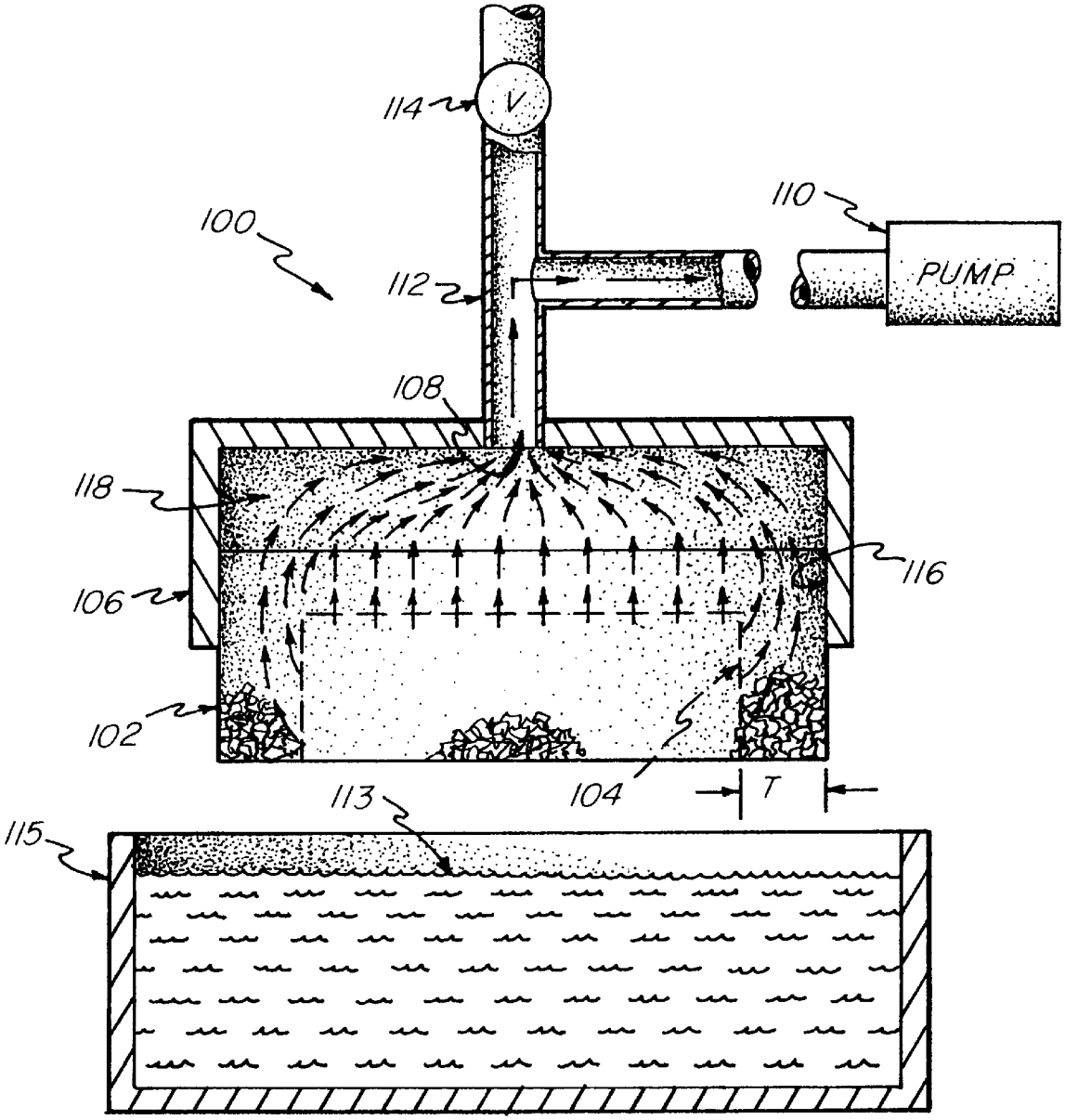
FIG. 1 is a schematic diagram of the apparatus for molding articles from a fibrous slurry.

Referring to FIG. 1, the apparatus for molding articles from a fibrous slurry, generally designated 100, of the subject invention is shown comprising a forming die 102 having molding surfaces 104, and a vacuum vessel 106 for supporting the forming die 102. The vacuum vessel 106 includes an opening 108 for communicating with a pump 110, or other conventional means, through conduit 112 to apply suction for drawing slurry 113, contained in a conventional supply tank 115, against the molding surfaces 104 of the forming die 102. A plug or valve 114 may be provided to permit draining of the conduit 112 after completion of the molding operation. The back portion 116 of the forming die 102 is adapted to fit into the vacuum vessel 106 in such a manner that a vacuum may be maintained within the vacuum vessel 106 during operation. Preferably, the vacuum vessel 106 is shaped to provide support and to lock the forming die 102 in position within the vacuum vessel 106 and to provide a suction recess 118 to allow for a substantially uniform suction pressure along the molding surfaces 104 of the forming die 102.

Figure 2:
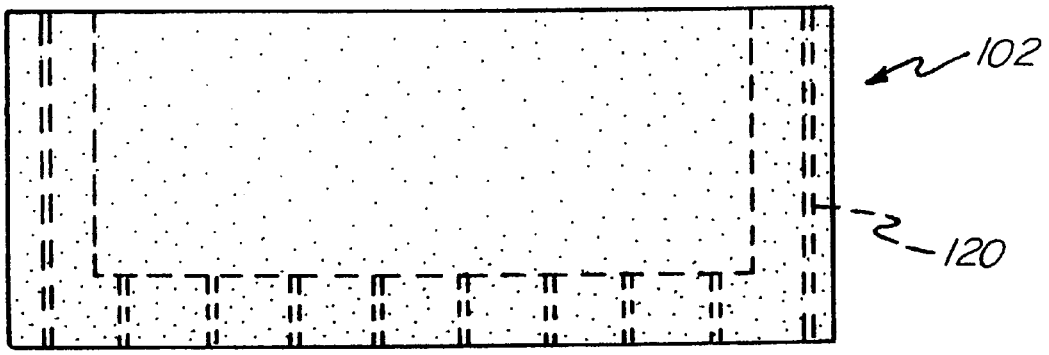
FIG. 2 is side view of another embodiment of the forming die of the present invention showing a plurality of perforations extending therethrough.
Figure 3:
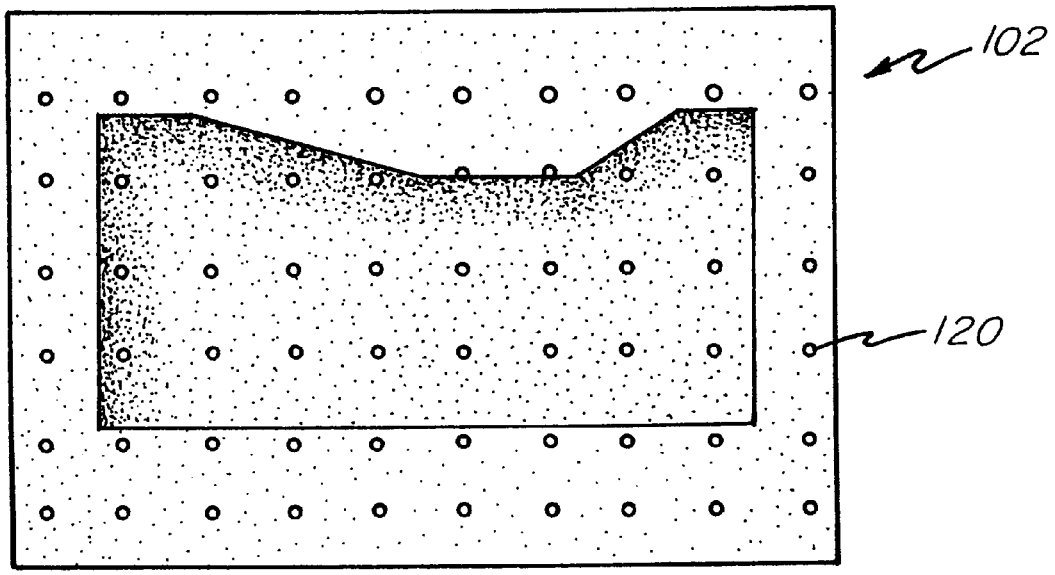
FIG. 3 is a top view of the forming die of FIG. 2.

In a preferred embodiment of the invention, as shown in FIGS. 2 and 3, the forming die 102 includes a plurality of perforations 120 extending inwardly through the die 102. During the molding operation, the perforations 120 are effective for reducing flow resistance or pressure drop of the air and the water, comprising the fibrous slurry, traveling through the forming die 102.

Figure 4:
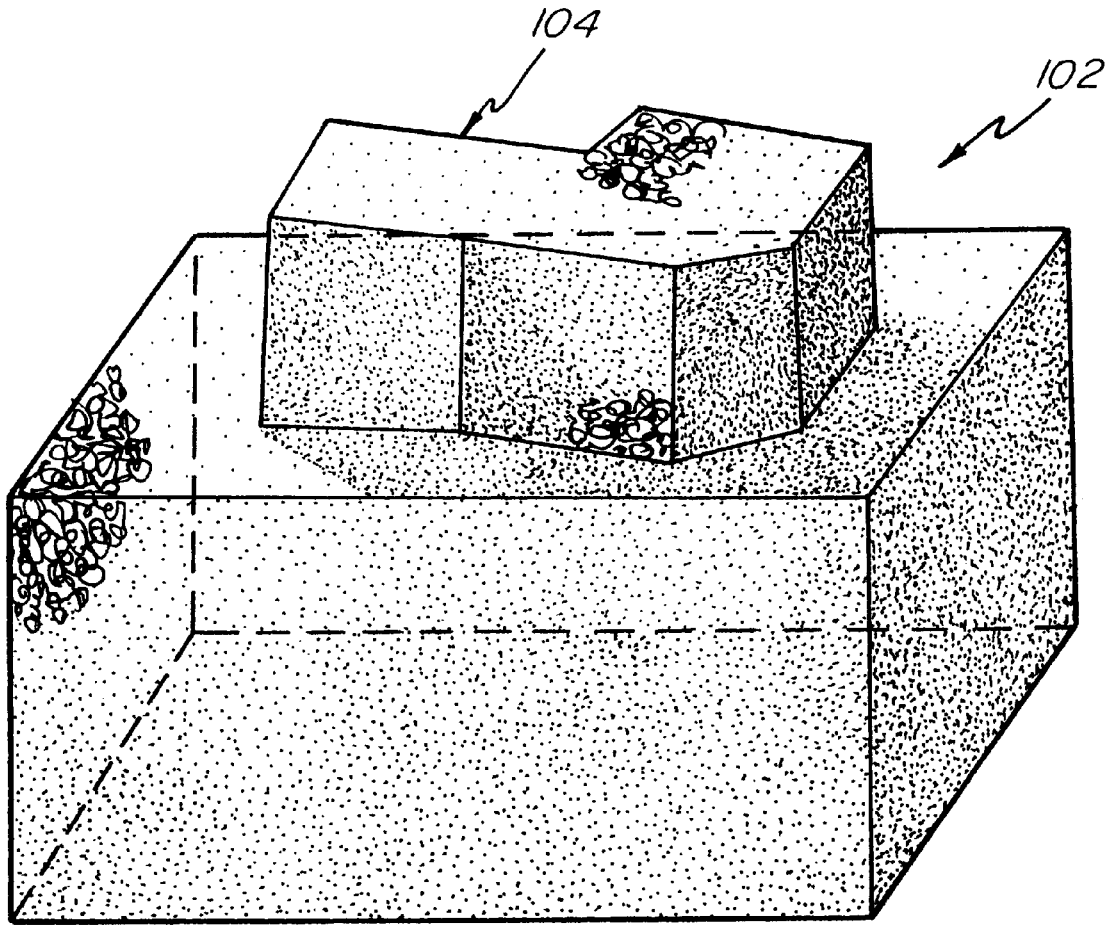
FIG. 4 is a pictorial view of the forming die of the present invention.

Referring to FIGS. 1 and 4, the forming die 102 may be formed from any material having the characteristics of being water-insoluble and porous. The material must also be sufficiently rigid to withstand the required vacuum pressures and easily shaped to permit the molding surfaces of the forming die, contrary to the accepted practice, to be constructed either by hand using simple hand-held cutting tools, or by machine using relatively simple manual tools, or automatically using computer controlled cutting tools. Such materials include, but are not limited to, phenol-formaldehyde resin foams, polyurethane resin foams, and urea-formaldehyde resin foams (such materials being commercially available from Smithers-Oasis U.S.A. of Kent, Ohio); ceramics; foam metals; and other similar materials. Accordingly, the forming die of the present invention may be manufactured with significantly less time and cost than conventional forming dies which require relatively labor intensive, time consuming, and expensive molding, machining and drilling, or electroforming operations. Further, it should now be apparent that the use of materials having the above-described characteristics permits the forming die of the present invention to be easily and inexpensively modified to allow for formed articles to be manufactured incorporating various design changes.

Figure 5:
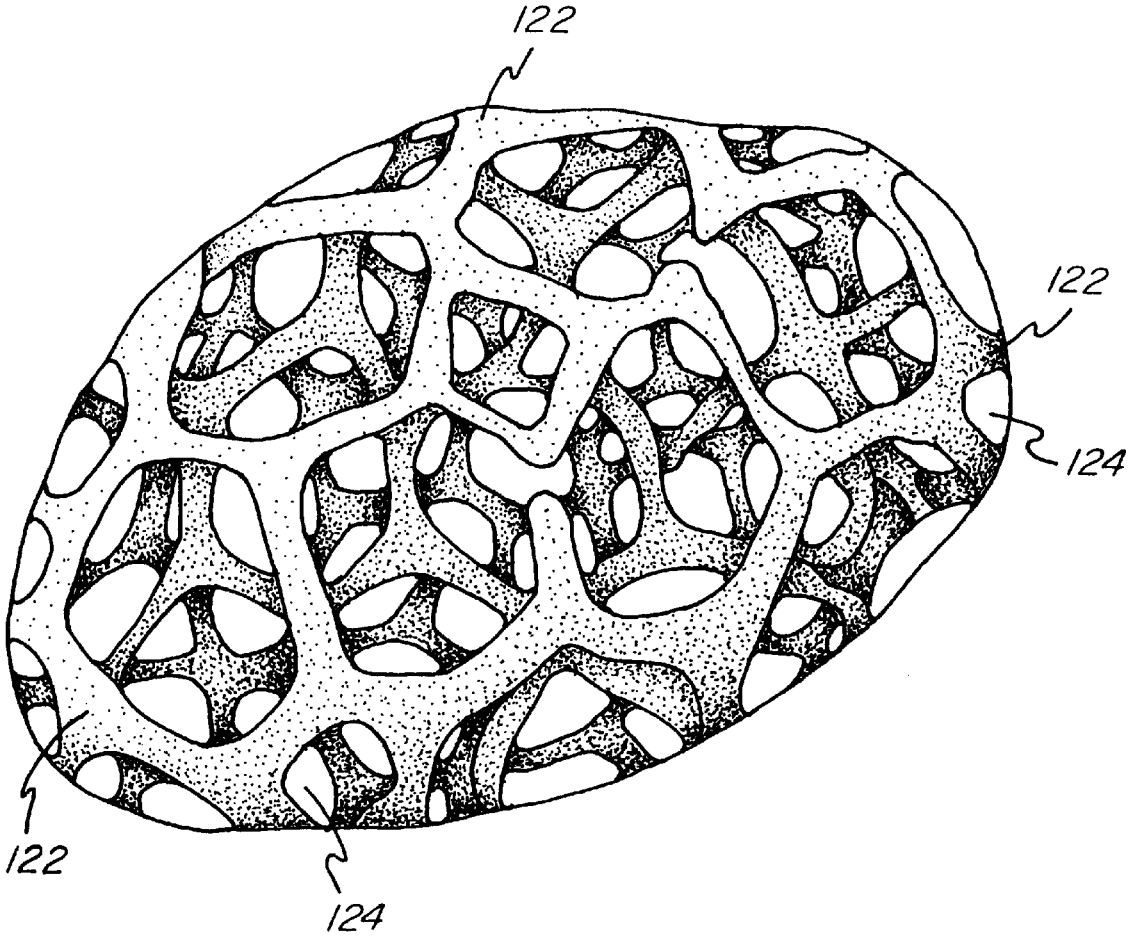
FIG. 5 is a greatly enlarged portion of the porous material comprising a preferred embodiment of the forming die of the present invention.
Figure 6:
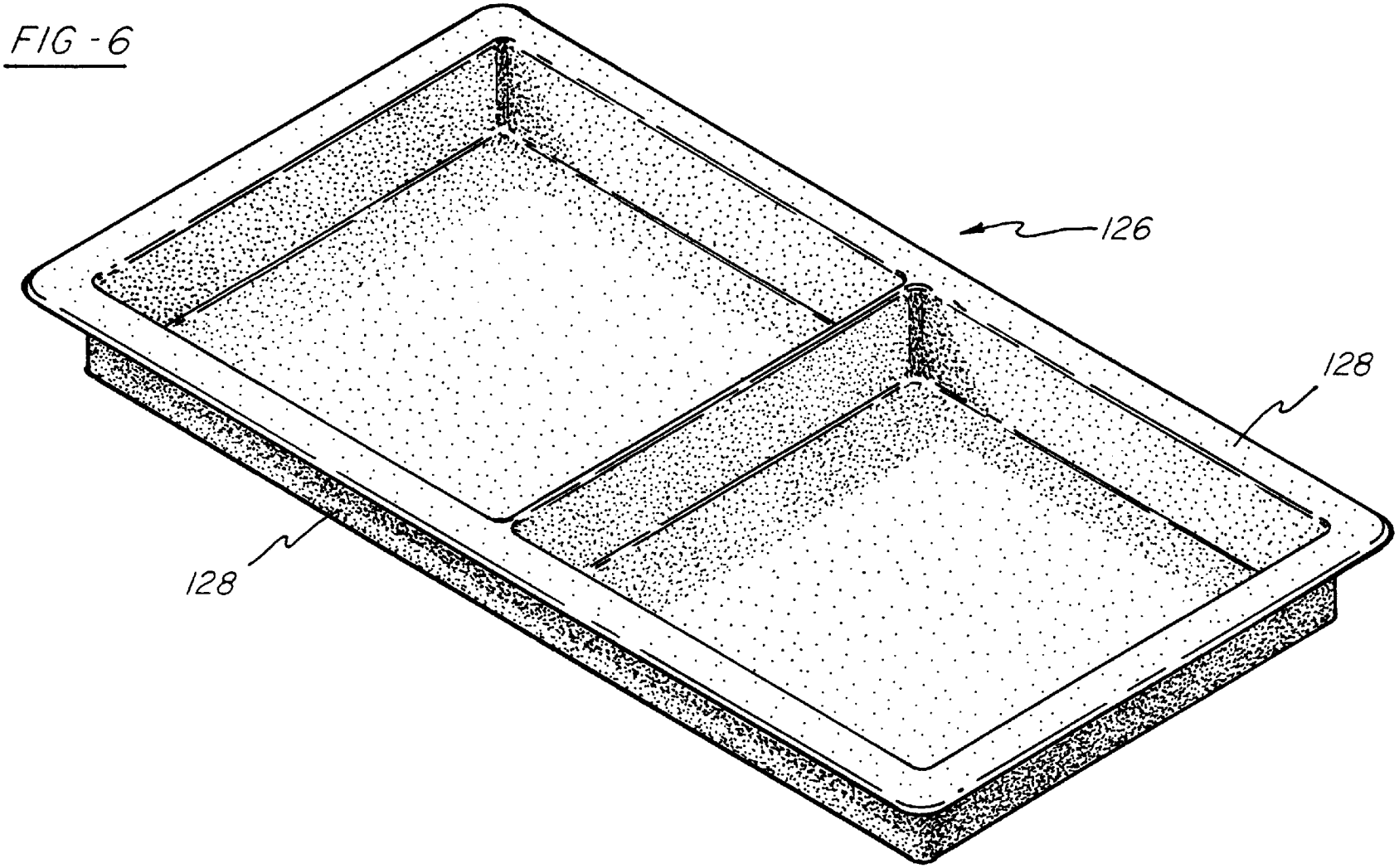
FIG. 6 is a pictorial view of a molded article formed by the apparatus and method of the present invention.

In a preferred embodiment of the invention, as shown in FIG. 5, the forming die 102 (FIG. 4) is formed from phenol-formaldehyde foam-like material comprising interconnecting walls 122 which define an open pattern of micronically sized interconnected cells 124 which join together to form irregular passages extending through the material comprising the forming die 102. The desired density of the material comprising the forming die 102 is dependant on the particular material selected. For an example, it has been found that when the forming die 102 is formed from a phenol-formaldehyde foam having a density of more than about 10 kg/m, the amount of suction necessary to draw water from the fibrous slurry significantly increases and may result in poor uniformity in the molding process and lower performance characteristics of the formed article 126 (FIG. 6). It has also been found that when the forming die 102 is formed from phenol-formaldehyde foam having a density less than about 35 kg/m, the surface 128 (FIG. 6) of the formed article 126 obtains a rough and undesirable appearance and would not accurately represent the production or final molded article. As shown in FIG. 1, the desired wall thickness, T, of the forming die 102 is also dependent on the particular material selected. It has also been found that when the forming die 102 is formed from phenol-formaldehyde foam the desired wall thickness, T, of the forming die 102 in the direction of water and air flow, as shown by arrows in FIG. 1, should be greater than about 0.2 mm and preferably about 0.5 mm in order to ensure that the forming die 102 has sufficient mechanical strength. From the foregoing, the desired density and wall thickness for the particular material selected should be readily determined by one of ordinary skill in the art.

According to the method of producing molded articles from a fibrous slurry of the present invention, a forming die comprising a water insoluble, porous, and relatively rigid and easily shaped material is provided having molding surfaces shaped, either by hand using simple hand-held cutting tools, or with relatively simple manual tools, or automatically with computer controlled cutting tools, in the configuration of the article to be molded. The forming die is then disposed into the vacuum vessel having at least one opening therein for providing flow communication with a pump or other like means. The molding surfaces of the forming die are then inserted into the fibrous slurry and a vacuum is then applied to draw the fibrous slurry against the molding surfaces of the forming die to form a fibrous layer. Water comprising the fibrous slurry is drawn through the forming die where it is drained out through a conventional plug or valve. The vacuum pressure necessary for drawing the fibrous slurry against the molding surfaces of the forming die may be readily determined by one of ordinary skill in the art and will depend on various process conditions such as the composition and viscosity of the slurry, the temperature of the slurry, and the configuration and wall thickness of the article to be produced. A vacuum pressure of about 25 to about 55 cm-Hg has been found to be satisfactory. When the vacuum pressure is less than about 25 cm-Hg, the fibrous slurry does not form as well along the molding surfaces of the forming die and may not result in the proper interlocking of the fibers comprising the formed article. For vacuum pressures greater than about 55 cm-Hg, the forming die begins to deteriorate and may result in the formed article having a poor appearance and would not accurately represent a production article.

When a fibrous layer has been deposited at the desired thickness upon the molding surfaces of the forming die, the forming die is removed from the slurry and the formed article is permitted to dry. After the formed article has dried sufficiently, it may be removed from the forming die by hand or mechanically with the application of air pressure through the forming die to push the formed article away from the molding surfaces of the forming die. In order to reduce drying time, the forming die and the formed article may be placed into a conventional oven having a temperature of less than about 315 degrees Centigrade, or subjected to microwave heating. The amount of time and the particular heating temperature may be readily determined by one of ordinary skill in the art.

Figure 7:
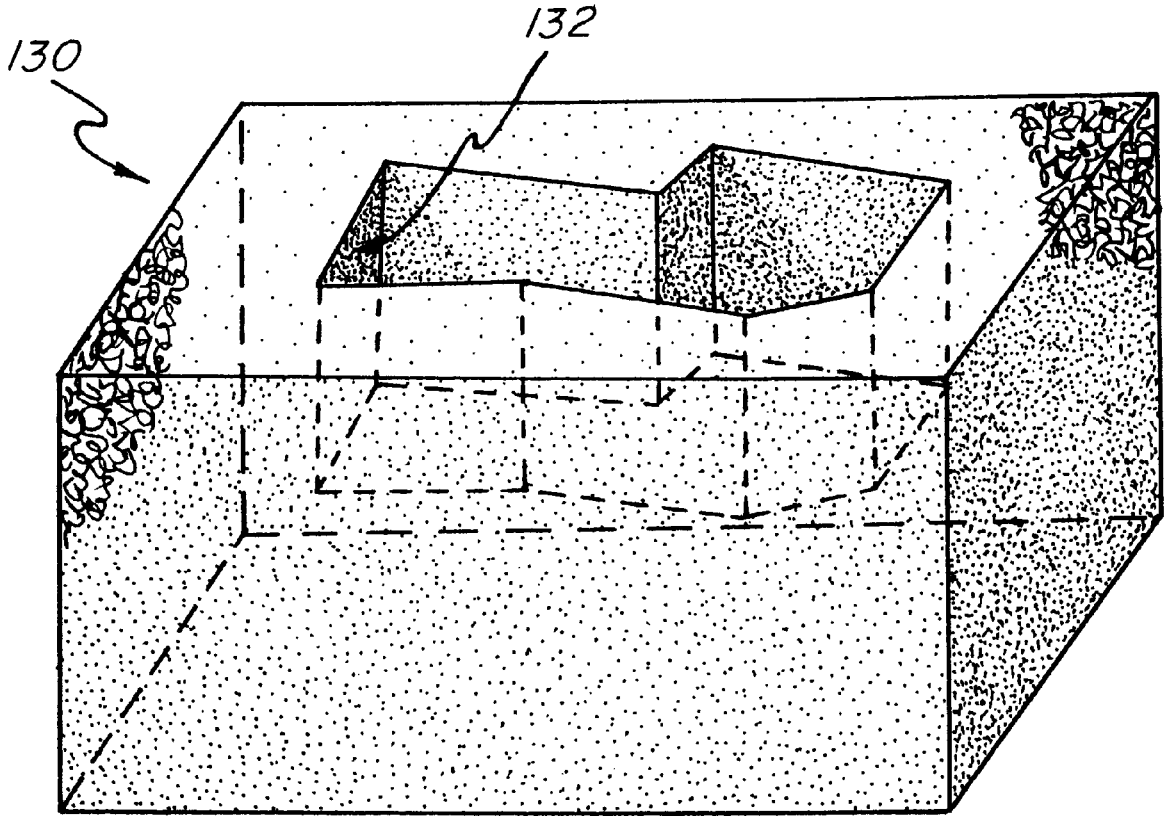
FIG. 7 is a pictorial view of a transfer die of the present invention.

It should also be understood that the formed article may also be removed from the forming die utilizing other conventional means, such as by use of a transfer die. In a preferred embodiment of the invention, as shown in FIG. 7, a transfer die 130 is formed from a water insoluble, porous, and relatively rigid and easily shaped material having surfaces 132 of similar configuration of the formed article 126. It should be apparent to one skilled in the art, that the transfer die 130 may be formed utilizing the method and materials disclosed herein for producing the forming die 102. The molding surfaces 104 of the forming die 102 are conventionally mated with the corresponding surfaces 132 of the transfer die 130 and the formed article 126 is transferred to the transfer die 130 by application of air pressure through the forming die 102. The formed article 126 can then be transported for further processing.

The present invention provides a novel apparatus and method of molding articles from a fibrous slurry. It should be apparent to one skilled in the art that the forming die of the present invention is much easier to construct and is significantly less expensive than conventional molding dies requiring relatively labor intensive, time consuming, and expensive pattern making, molding, drilling, machining, or electroforming operations. Accordingly, the apparatus and method of molding articles from a fibrous slurry of the present invention permits the manufacturer to produce specimens of a molded article which may be utilized for providing accurate shock-absorbing testing, which produces articles with the appearance and performance and which accurately represents a production article, which can be easily modified to incorporate various design changes, and which can be produced in a relatively short period of time and with little expense.

While the method herein described, and the forms of apparatus for carrying this method into effect, constitute preferred embodiments of this invention, it is to be understood that the invention is not limited to the precise method and forms of apparatus, and that changes may be made in either without departing from the scope of the invention, which is defined in the appended claims.

What is claimed is:

1. A method for molding articles from a fibrous slurry comprising fibers and water, the method comprising the steps of:

constructing a first forming die for producing a molded article for testing, said forming die having molding surfaces contoured to the same shape as the article to be molded;

inserting said first forming die into the fibrous slurry;

applying vacuum pressure to provide suction through said first forming die to draw the fibrous slurry against said molding surfaces of said first forming die and to draw water through said first forming die to form a molded article;

removing said first forming die from the fibrous slurry;

removing said molded article from said first forming die;

testing said molded article to determine the shock-absorbing characteristics of said molded article; and using said first forming die to create a second forming die and repeatedly using said second forming die for producing a plurality of finished products;

wherein said first forming die for producing a molded article for testing is made from a water insoluble material comprising a plurality of interconnecting walls which define an open pattern of interconnected cells which join together to form irregular passages extending through said material and sufficiently sized for drawing water from the fibrous slurry through said first forming die, and wherein said porous material can be shaped using hand-powered cutting tools.

2. The method of claim 1 wherein said porous material comprises a plurality of interconnecting walls which define an open pattern of micronically sized interconnected cells which join together to form irregular passages extending through said porous material.

3. The method of claim 1 further comprising the steps of:

heating said first forming die to dry the molded article; and removing the article from said first forming die.

4. The method of claim 1 wherein said first forming die includes a plurality of inwardly extending perforations.

5. The method of claim 1 wherein said material is a synthetic resin foam.

6. The method of claim 1 wherein said material is a phenol-formaldehyde resin foam.

7. The method of claim 1 wherein said material is a polyurethane resin foam.

8. The method of claim 6 wherein said material has a density of about 10 to about 35 Kg/m.

9. The method of claim 1 wherein said suction is applied to produce uniform suction pressure across said molding surfaces of said first forming die for forming articles.

10. The method of claim 1 wherein the formed article is removed from said first forming die by a transfer die formed from a water insoluble, porous material.

11. The method of claim 1 wherein said suction is about 27 to about 51 cm-Hg.

* * * * *